US005947720A

United States Patent [19]

Kelly

[11] Patent Number: 5,947,720

[45] Date of Patent: Sep. 7, 1999

[54] APPARATUS FOR PREPARING MATERIALS FOR ROAD REPAIR

[75] Inventor: Michael Francis Kelly, Bury St. Edmunds, United Kingdom

[73] Assignee: Proteus Equipment Limited, Suffolk, United Kingdom

[21] Appl. No.: 08/987,459

[22] Filed: Dec. 9, 1997

[51] Int. Cl.[6] ..... B28C 5/46; F27B 7/34

[52] U.S. Cl. ..... 432/105; 219/390; 366/24; 366/25

[58] Field of Search ..... 432/103, 105, 432/107, 112, 114; 219/385, 386, 389, 390; 366/22, 23, 24, 25, 54, 144; 34/108, 109, 142; 47/1.42

[56] References Cited

U.S. PATENT DOCUMENTS

| | | | |
|---|---|---|---|
| 1,875,516 | 9/1932 | Stary | 366/24 |
| 1,952,464 | 3/1934 | Rybeck | 366/24 |
| 3,786,162 | 1/1974 | Colson | 219/390 |
| 4,006,889 | 2/1977 | Perrott, Sr. | 259/176 |
| 4,462,690 | 7/1984 | Wirtgen | 432/105 |
| 4,510,369 | 4/1985 | Harrison | 219/390 |
| 4,677,761 | 7/1987 | Rattner | 34/108 |
| 4,684,342 | 8/1987 | Harcuba | 432/103 |
| 4,889,484 | 12/1989 | Przewalski | 432/103 |
| 4,946,283 | 8/1990 | Musil | 366/25 |

FOREIGN PATENT DOCUMENTS

| | | |
|---|---|---|
| 762796 | 12/1956 | United Kingdom . |
| 999541 | 7/1965 | United Kingdom . |

*Primary Examiner*—Teresa Walberg
*Assistant Examiner*—Gregory A. Wilson
*Attorney, Agent, or Firm*—Sheridan Ross P.C.

[57] ABSTRACT

Portable-to-site apparatus is operative to produce ready-to-lay traffic-wear surfacing and/or road etc course materials. A drum-like container is supported for axial rotation within insulation walling of a heating chamber allowing front access to one end closure of the rotatable container and affording operative association with heating means for raising temperature of contents of the container by heat transfer through side walling of the container. Normal operation is with the container sealed and under appropriate control as to time, heating, even rotation. The container is frame-mounted for tilting to aid loading and/or unloading.

22 Claims, 4 Drawing Sheets

APPARATUS FOR PREPARING MATERIALS FOR ROAD REPAIR

FIELD OF THE INVENTION

1. Description

This invention relates to patching traffic-wear surfaces or wearing courses of such as roads, vehicle parks, forecourts, paths etc; and preparation of materials therefor, including portable-to-site apparatus.

2. Background of the Invention

Traditional surfacing or wearing course materials generally include asphalts and bituminous tarmacadams containing aggregates suitably bound together. Other surfacing materials that have become available include those using so-called polymer modified binders, which often offer advantages at least in terms of layer thicknesses, thus quantities, required relative to desired wear factors. The traditional materials are available on a local basis throughout the U. K. in ready-to-use and easy-to-handle forms, including in small amounts to use for patching, as required to repair selective wear or reinstate after disturbance (say by or for supply utilities for various services); and achieving acceptably matching appearance is rarely a problem. However, other materials using polymer modified binder materials do tend to produce at least appearance problems, as they are usually made up and laid at high temperatures using large and expensive specialised plant. They set very hard and are not seen as storing or travelling well in ready-to-use form, particularly in small quantities as often required for such patching; and making up small batches is very expensive. If patching is done using dense tarmacadam, performance can further be problematic, but at least appearance is a strongly adverse factor affecting take up and use of available polymer modified binder road etc surfacing materials, generally.

This invention arises fro and resides in seeking to provide method and means, particularly readily portable-to-site materials preparation apparatus, facilitating such patching, including applicable to polymer modified binder materials.

SUMMARY OF THE INVENTION

According to one aspect of this invention there is provided portable-to-site apparatus for producing ready-to-lay traffic-wear surfacing and/or road etc course materials, the apparatus comprising a drum-like container supported for axial rotation within insulation walling of a heating chamber allowing front access to one end of the rotatable container and affording operative association with heating means for raising temperature of contents of the container by heat transfer through side walling of the container, said one end of the container having closure means for selectively sealing or allowing access for loading and unloading for said material or constituents to be mixed.

Preferably, the container can be tilted to lower said one end and aid at least unloading and/or to raise said one end and aid at least loading, say by way of an upper frame part carrying at least said container and heating chamber/heating means and pivotted medially to a lower frame part having associated, preferably powered, tilting means. For apparatus dealing with smaller batch sizes, say about 25/50 Kilograms perhaps up to 250 Kilograms or more, the upper frame part can usefully further carry drive provision for rotating the container (including prime mover motor/engine and gearbox etc transmission). Alternatively, say for apparatus dealing with larger batch sizes approaching 250 Kilograms through to 1,000 kilograms or so, at least prime mover part(s) of drive provision for rotating the container can be provided separate from said upper frame part, say including a hydrostatic pump and flexible connector means to hydrostatic motor means associated with drive shaft of the container.

Typical apparatus hereof has heating chamber has venting above said access, say by chimney-like provision through top walling of the heating chamber.

At least where the rotatable container has a particular normal rest position, said closure means can usefully be of two-part form, say presenting a lower part with selective porting to permit said unloading and an upper part to open/remove separately for said loading. Unloading chute means may be supported adjacent to but separately from the container at its said one end.

Preferred control means includes providing variously for variable timing and thermostatic heating, including internal temperature sensing for the container, and target temperature and time setting means for said heating and rotating means to operate according to said setting means.

For road etc patching materials using polymer modified binder type, typical apparatus hereof permits two methods of materials preparation, one from freshly mixed constituents and preferably as pre-dried and pre-graded packs/bags (conveniently 25- or 50- Kilogram sizes) along with pre-packed normally solid binder to be added when the aggregate has been heated to a specified temperature suited to the mix and binder concerned, and usually further mixed for only a few minutes; the other using pre-bagged mixed and prepared hard-set cold surfacing material (say produced when making much larger quantities, usually to be hot-laid as-made, specifically as additional material to the then required precise quantity and bagging up for future used in cold hard-set form as herein from plural similar or even different sizes of bag), for gentle re-heating in apparatus hereof to achieve workability, usually with only small change to hardness/strength, softening point and ductility, typically within or little if any more than about 5%. In one specific example (using the binder Olexeobit 100), there was slightly lower pen value of 70 dmm rather than 74 dmm slightly higher softening point at 50.6° C. rather than 49° C.) and slightly higher ductility recovery at about 67.5% rather than 60%).

This batch processing, particularly using convenient predetermined solid unit quantities, even shapes of preformed material to be reconstituted by re-heating, is seen as having novelty and merit relative to on-site preparation using controlled heating that avoids any contact involving any temperature at which needed volatile constituents might be lost, as readily controllable using by said heating being from outside the drum/container, preferably with rotary movement, advantageously continuous rather than oscillatory, agitation aid at least by internal bumps or vanes or blades, and sensing temperature of outside of the drum/container in achieving temperature and consistency for laying.

Moreover, it is also possible and advantageous to use apparatus hereof for fresh mixing batches of conventional asphalt and tarmacadam, again preferably in a carefully controlled manner using pre-dried and pre-graded bags of aggregates to be heated first and predetermined blocks of bitumen to be added at achieving prescribed temperature; and/or for recycling recovered materials, typically from excavating and/or surface planing, simply placed into the drum/container of apparatus hereof and heated along with adding proprietary rejuvenator(s), usually in emulsion form, at achieving a preset temperature, followed by continuing heating and drum rotation to complete thorough mixing and achieve layable state and temperature, relative to assessing which, a thermometer operative in the material itself inside the drum/container, conveniently through the front closure, is very useful.

Container contents, in terms of traffic-wear/wearing course material, can successfully be as low as about ten per cent of internal container volume, or as high as about forty percent, perhaps more.

Target and achieved temperatures for control purposes can typically be of the order of 150° C.–180° C., or as low as 120° C. or even 60° C. or less, or as high as about 200° C., depending on particular mix type(s). Typical times for batch preparation can be no more than about ten to twenty minutes or so, at least for small batches.

A suitable horizontally-rotatable container comprises a drum of robust material having good heat transfer characteristics, usually metal, typically steel; the drum being open at one end for closure by a removable cover, preferably ventable and of or faced with heat-insulating material, and being returned closed over its other end having external coupling provisions for rotation, say to a rotatable shaft. The open end of the drum may be outwardly flanged to receive the removable cover, which may have a central vent, but otherwise be in operative sealed relation to the drum during heating of the drum.

Suitable heating means comprises an arcuate array of parallel elongate heaters, such as ribbon-type gas heaters, say for bottled gas such as propane. Such arcuate array is conveniently about a lower part of horizontally rotatable said container or drum, with each elongate heater of shallow U-, even top-hat, shape to give even heating of drum/container contents, including at ends as well as medially.

Suitable temperature control can be by way of sensing temperature at outside of the container drum accompanied by switching off the heating at target temperature, and switching the heating back on after a predetermined drop in sensed temperature, say about 5° C. Suitable temperature sensing could be of infra-red or thermo-couple, even direct contact types, but typically shielded from any heating gas exhaust and in effective proximity to the exterior of the container or drum.

Preferred operation is with the container substantially sealed until end of desired heating, save normally for venting internal overpressure, typically through a filter, conveniently of activated carbon, say in or via said cover vent. Preferably, opening of the container or drum after heating operation ends is preceded by exhausting gaseous products from the container or drum, further preferably flushing same, typically with air. These can be achieved by a suction pump at the cover vent with filter fitted, say with an inlet air vent opened through rotary drum shaft provision, or by a pump feeding such inlet air vent.

BRIEF DESCRIPTION OF THE SEVERAL VIEWS OF THE DRAWINGS

Specific implementation will now be described, for three exemplary apparatus embodiment of this invention, with reference to the accompanying diagrammatic drawings, in which.

DETAILED DESCRIPTION OF THE INVENTION

Figure 1:
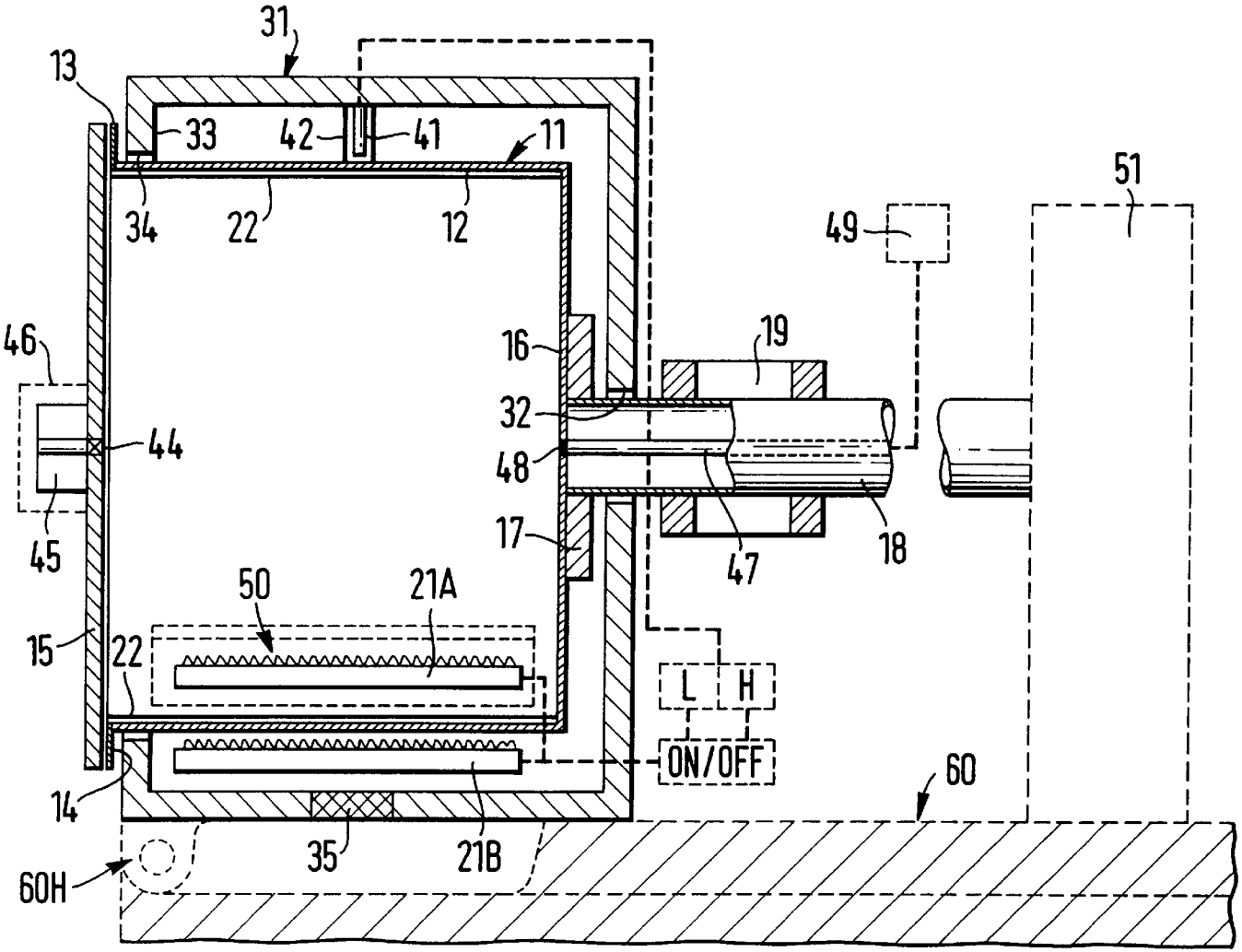
FIG. 1 is outline long sectional view through one embodiment.

In FIG. 1, a drum-shaped container 11 is shown in generally horizontal disposition of its cylindrical side walling 12 extending between one end 13 shown exteriorly flanged at 14 to take an insulating cover closure 15 in substantially sealing relation and its other end 16 shown returned closed past drive coupling 17 shown to a rotary drive shaft 18 shown in a bearing 19.

Also shown are two (21A,B) of a lower arcuate array of three elongate heaters at the bottom of the drum 11. These heaters (21A,B) are typically, though not necessarily, of gas-burning types, usually for bottled gas such as propane. There may be more or fewer heaters or lines of heaters than the three indicated and/or other distributions of other discrete heaters/burners as desired or preferred. The cylindrical walling 12 of the drum will have good heat transfer characteristics and parallel elongate internal bumps 22 are shown. There may be as many bumps or ribs 22, or alternative vanes etc, and of such height, spacing and sectional shape, even path configuration as found useful, for example inclined to aid said unloading.

The drum 11 and heaters 21 are shown within an insulating enclosure as a heating chamber 31 having end aperture 32 for the drive shaft 18, end return(s) 33 to another aperture 34 for the cylindrical walling 12 of the drum 11, and bottom grating 35 for air inlet to the gas burning heaters 21. Burnt gas exhaust will be past the end return(s) 33 and the spaced confronting drum flanging 14.

A temperature sensor is shown at 41 within shielding 42 and serves for sensing the temperature of the exterior of the drum walling 12 substantially unaffected by gas exhaust. Gas supply control, see dashed lines, is by turning OFF then ON again at sensing high (H) and low (L) temperatures by the sensor 41. Either of gas pilot light provisions (not shown) or direct electronic ignition can be used.

The cover 15 is removable from its unshielded substantially sealing relation with the drum flanging 14; and has a central outlet vent 44 which can be of a one-way valve type to a suitable filter 45, say of activated carbon. The filter 45 is indicated in operative relation with a suction pump 46 for operation in clearing and flushing the drum 11 after an intendedly effective heating cycle. The drive shaft 18 is shown with a communication line 47 to an air inlet vent 48 to the drum 11 that may also be of one-way type or further preferably pressure regulated to open only with operation of the suction pump 46, alternatively a positive pressure air pump 49 on the line 47.

Stripped bag contents of hard-set cold polymer modified binder material 50 are shown installed in the drum 11 for a prescribed period of heating through and after first reaching the high temperature, as found to be satisfactory in practice for such particular material as is being re-treated (by heat and rotation) for use. Larger and/or more units of material 50 may require longer rotary heating times and/or different rotation speeds.

The whole equipment is shown on a base 60, actually indicated hinged thereto at 60H for tipping after removing the closure cover 15; including a prime mover 51, such as a small internal combustion engine though any motive power, including a take-off from other equipment, can be suitable.

Figure 2A:
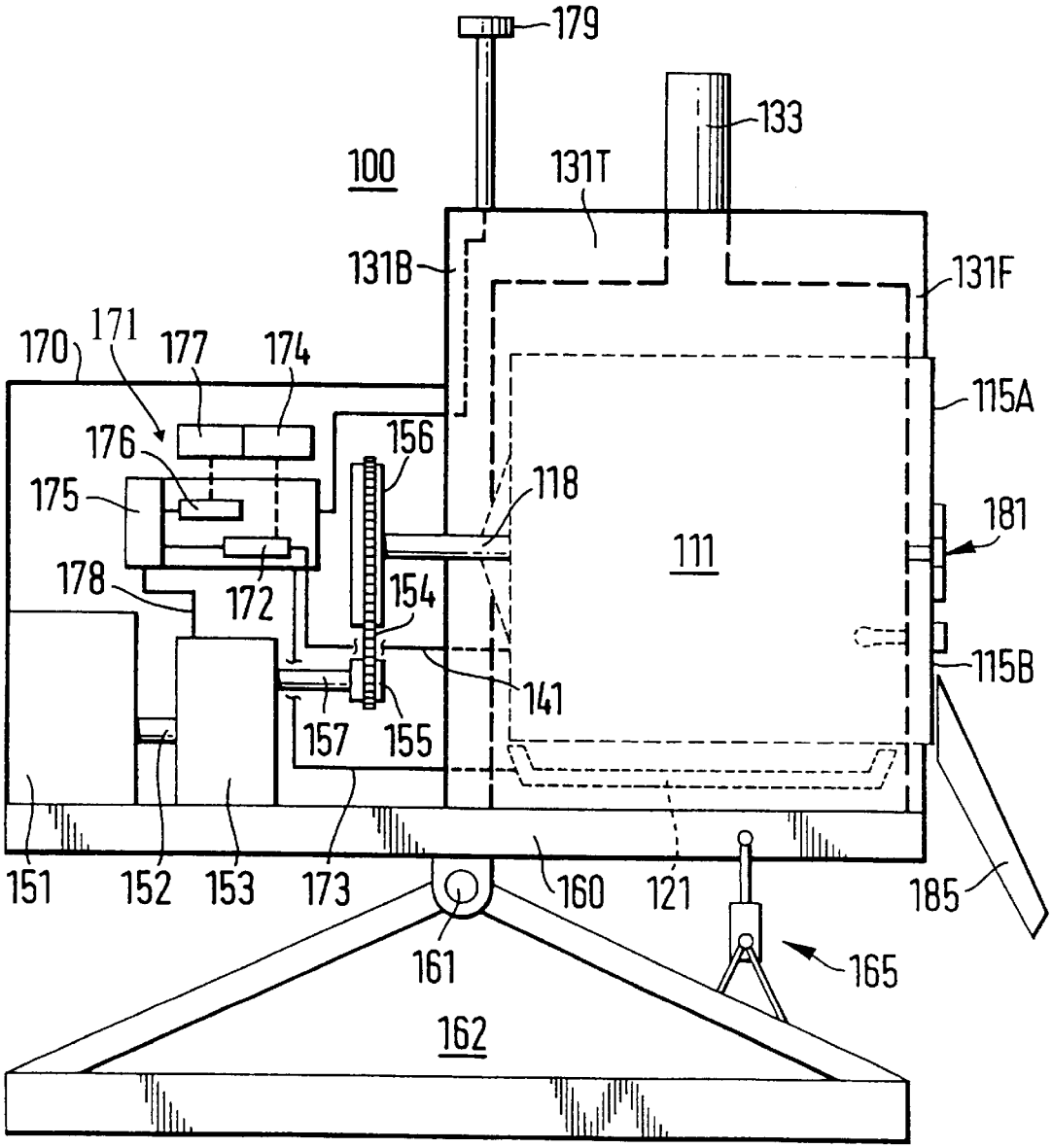
FIGS. 2A, B are outline side and front views of a second embodiment.
Figure 2B:
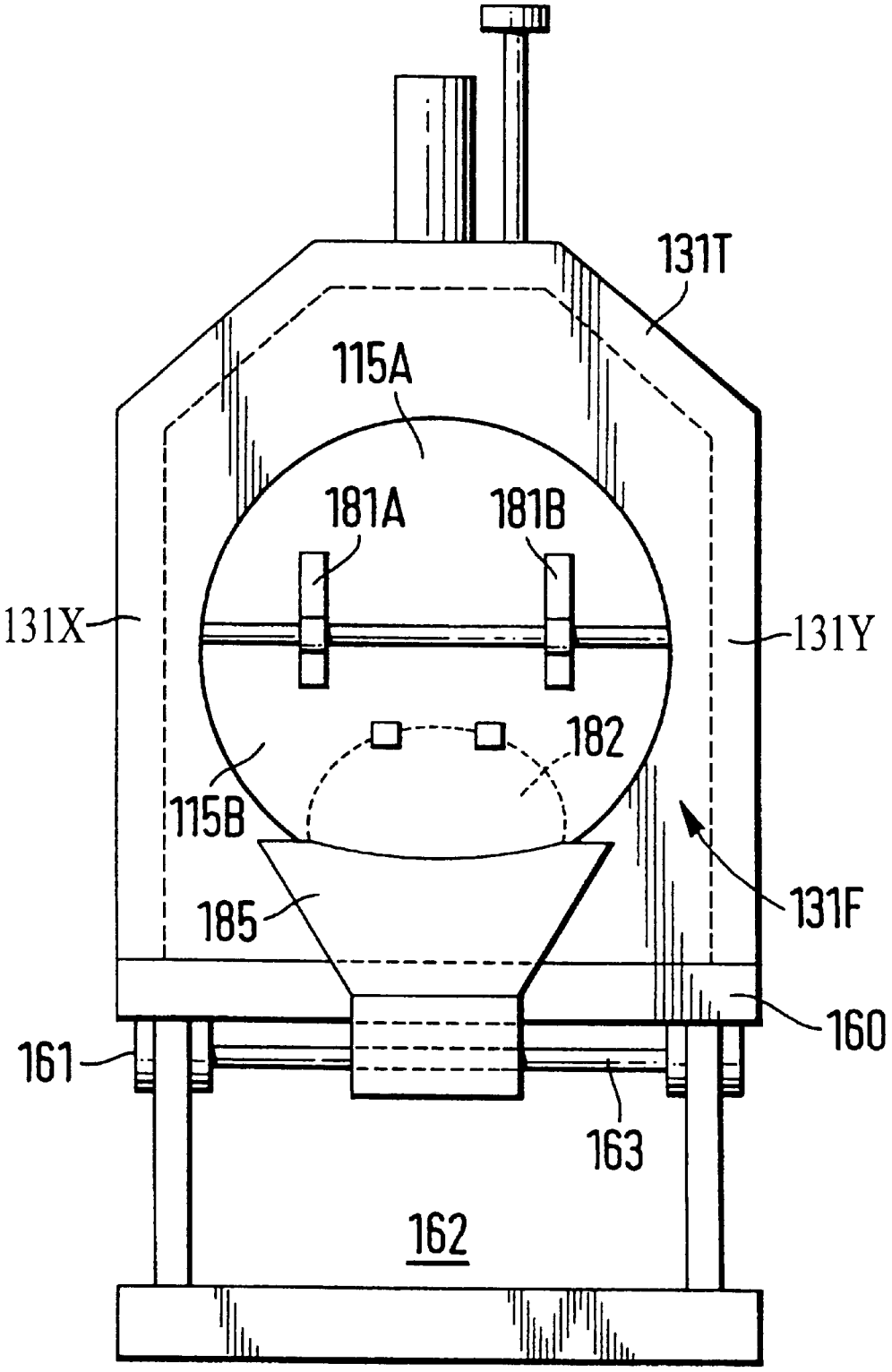

FIGS. 2A and 2B show various practical detail modifications and/or improvements, including simplifying heating chamber/insulating enclosure 131 for drum 11 by omitting bottom insulation, see top (131T), sides (131X, Y) and back/front (131B/F) walling with chimney-like venting 133 through the top walling 131T. Cover 170 is shown for engine 151, now together with transfer shaft 152 to gear box 153 (by which speed changes can be available) and reduction chain gearing/drive 154 via smaller and larger 155 and 156 sprockets on gear box output shaft 157 and drum drive shaft 118. Control provisions 171 include thermostatic at 172 for heater(s) 121 (over 173) according to sensed (over 141) and target temperatures shown capable of being set at will (174) or from mode selection (175); and timing (176) also shown settable at will (177) or from mode selection 175 also indicated capable (over 178) of setting rotation speed at gearbox 153 also normally manually set. A mast-mounted warning beacon 179 will normally give visual and/or audible indication of normal operation and/or system malfunction.

Front closure for the drum 111 is indicated as being of two-part nature by way of upper and lower half-doors 115A, B conveniently removable (115A) and hinged or ported (115B), respectively, see at 181A/B and/or 182 and material discharge chute 185. The drum will 111, of course have a corresponding rest position. All of the drum 111 in the insulated heating chamber 131, and drive provision under the cover 170 are shown mounted on upper frame 160 that is medially, specifically substantially centrally, pivoted at 161 to lower frame or base 162, see axle 163 (though side hinging is equally feasible). Powered tilting provision is shown via pressure-fluid-operated ram 165. Immediate mixed and/or rejuvenated material temperature can be checked as ready-to-use by way of a thermometer through the lower front door part 115B.

Figure 3:
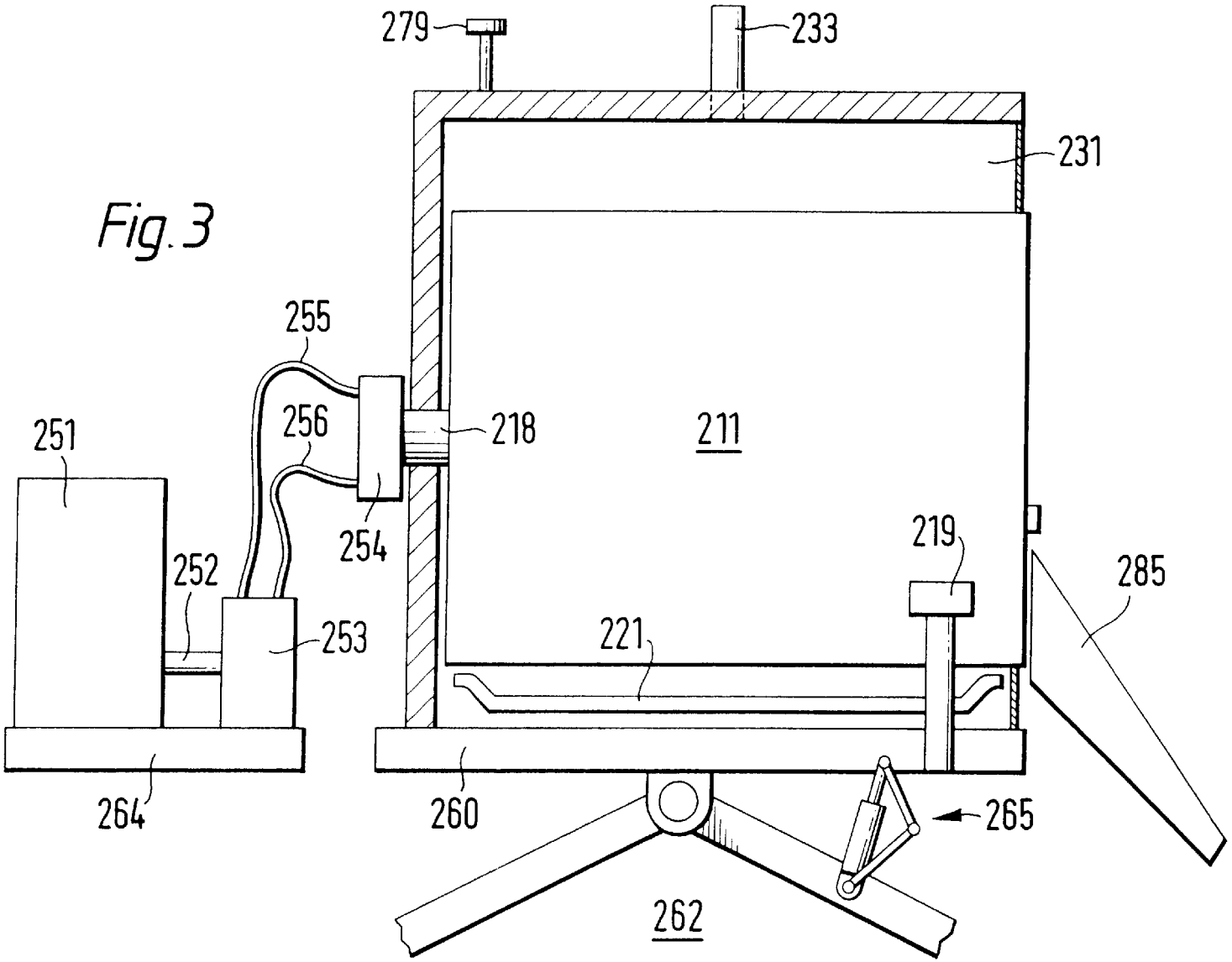
FIG. 3 is outline side view of a third embodiment.

It is envisaged that apparatus design such as shown in FIG. 2 is readily suitable for several equipment sizes, say to cope with producing batches of from about 25 Kilograms to as much as 250 Kilograms, maybe more. However, for larger batch sizes, say approaching 250 Kilograms up to about 1,000 Kilograms or more, pivoting frame mounting is envisaged for only the drum and heating chamber, see 211/231 and 260/262/265 in FIG. 3, along with pressure-fluid drive provision, see hydrostatic motor 254 on the drum drive shaft 218 and flexible hoses 255, 256 from hydrostatic pump 253 provided separately along with associated engine 251 and drive shaft 252, see on frame 264. At least for such larger capacity rotatable drum 211, further and more forward support may be desirable or required, e.g. by way of roller trunnions, see 219.

I claim:

1. A portable-to-site apparatus for producing ready-to-lay traffic-wear surfacing materials, the apparatus comprising:

a drum-like container for mixing traffic-wear surfacing materials, said drum-like container being supported for axial rotation and having a side walling defining an opening;

heating means outside the drum-like container for raising temperature of traffic-wear surfacing materials contained therein solely by heat transfer through said side walling such that traffic-wear surfacing materials are prevented from contacting said heating means;

insulation walling means defining a heating chamber housing said drum-like container and said heating means; and closure means in said insulation walling means for selectively sealing or allowing access through said opening for loading traffic-wear surfacing materials into the drum-like container and for subsequently unloading traffic-wear surfacing materials therefrom.

2. Apparatus according to claim 1, wherein the heating chamber has venting above said access.

3. Apparatus according to claim 2, wherein said venting is by chimney-like provision through top walling of the heating chamber.

4. Apparatus according to claim 1, wherein the container is tiltable to lower said one end and aid at least unloading.

5. Apparatus according to claim 4 wherein an upper frame part carrying at least said container chamber and heating means is pivoted medially to a lower frame part having associated tilting means.

6. Apparatus according to claim 5, wherein the tilting means comprises pressure-fluid-operated ram means.

7. Apparatus according to claim 5, wherein the frame part further carries drive provision for rotating the container.

8. Apparatus according to claim 7, wherein the drive provision comprises a prime mover motor or engine and transmission gear to drive shaft of the container.

9. Apparatus according to claim 5, wherein at least prime mover part(s) of drive provision for rotating the container are separate from said upper frame part.

10. Apparatus according to claim 9, wherein said part(s) drive provision include a hydrostatic pump and flexible connector means to hydrostatic motor means associated with drive shaft of the container.

11. Apparatus according to claim 1, wherein the container is tiltable to raise said one end and aid at least loading.

12. Apparatus according to claim 11, wherein an upper frame part carrying at least said container chamber and heating means is pivoted medially to a lower frame part having associated tilting means.

13. Apparatus according to claim 12, wherein the tilting means comprises pressure-fluid-operated ram means.

14. Apparatus according to claim 12, wherein the frame part further carries drive provision for rotating the container.

15. Apparatus according to claim 14, wherein the drive provision comprises a prime mover motor or engine and transmission gear to drive shaft of the container.

16. Apparatus according to claim 12, wherein at least prime mover part(s) of drive provision for rotating the container are separate from said upper frame part.

17. Apparatus according to claim 16, wherein said part(s) drive provision include a hydrostatic pump and flexible connector means to hydrostatic motor means associated with drive shaft of the container.

18. Apparatus according to claim 1, wherein the rotatable container has a normal, rest position where said closure means presents a lower part with selective porting to permit said unloading and an upper part to open separately for said loading.

19. Apparatus according to claim 1, comprising unloading chute means supported adjacent to but separately from the container at its said one end.

20. Apparatus according to claim 1, comprising control means included for timing and thermostatic heating including internal temperature sensing for the container, and target temperature and time setting means for said heating and rotating means to operate according to said setting means.

21. An apparatus for preparation of surfacing materials including a thermoplastic component, comprising:

a chamber, said chamber having an opening with closure means for selectively covering the opening, said opening allowing loading and unloading of said surfacing materials;

a container for mixing surfacing materials, said container having side walling housed within said chamber, said container for receiving said surfacing materials through said opening;

drive means for rotating said container to agitate said surfacing materials received therein; and heating means outside the container for raising temperature of said surfacing materials received in said container solely by heat transfer through said side walling of said container such that surfacing materials are prevented from contacting said heating means.

22. Apparatus according to claim 21, wherein said chamber is portable.

* * * * *